US008443917B2

(12) United States Patent
Püttmann

(10) Patent No.: US 8,443,917 B2
(45) Date of Patent: May 21, 2013

(54) INSERTION COUPLING FOR A BORING ROD ASSEMBLY AND A BORING ROD ASSEMBLY

(75) Inventor: Franz Josef Püttmann, Lennestadt (DE)

(73) Assignee: Tracto-Technik GmbH & Co. KG, Lennestadt (DE)

( * ) Notice: Subject to any disclaimer, the term of this patent is extended or adjusted under 35 U.S.C. 154(b) by 300 days.

(21) Appl. No.: 12/871,292

(22) Filed: Aug. 30, 2010

(65) Prior Publication Data

US 2011/0209920 A1 Sep. 1, 2011

(30) Foreign Application Priority Data

Aug. 28, 2009 (DE) ..... 10 2009 039 020
Nov. 7, 2009 (DE) ..... 10 2009 052 335

(51) Int. Cl.
*E21B 17/00* (2006.01)

(52) U.S. Cl.
USPC ..... 175/320; 285/147.1

(58) Field of Classification Search
USPC ..... 175/320; 166/242.6; 285/147.1
See application file for complete search history.

(56) References Cited

U.S. PATENT DOCUMENTS

| | | | | |
|---|---|---|---|---|
| 2,267,904 | A * | 12/1941 | Evans | 464/73 |
| 7,318,490 | B2 * | 1/2008 | Tjader | 175/57 |
| 7,942,218 | B2 * | 5/2011 | Cooley et al. | 175/432 |
| 2006/0110219 | A1 | 5/2006 | Püttmann | |
| 2008/0099242 | A1 * | 5/2008 | Tjader | 175/50 |
| 2008/0245573 | A1 | 10/2008 | Püttmann | |
| 2008/0257609 | A1 | 10/2008 | Püttmann | |
| 2008/0289879 | A1 * | 11/2008 | Kessler | 175/320 |
| 2009/0003935 | A1 | 1/2009 | Püttmann | |
| 2009/0008087 | A1 * | 1/2009 | Getman et al. | 166/242.6 |
| 2009/0211812 | A1 | 8/2009 | Püttmann | |
| 2009/0255701 | A1 | 10/2009 | Püttmann | |
| 2010/0150643 | A1 | 6/2010 | Püttmann | |
| 2010/0196089 | A1 | 8/2010 | Püttmann | |
| 2010/0252228 | A1 | 10/2010 | Püttmann | |
| 2010/0282517 | A1 | 11/2010 | Püttmann | |

FOREIGN PATENT DOCUMENTS

| | | | |
|---|---|---|---|
| CH | 603990 | A5 | 8/1978 |
| DE | 19725628 | C1 | 3/1999 |

* cited by examiner

*Primary Examiner* — William P Neuder
(74) *Attorney, Agent, or Firm* — Henry M. Feiereisen LLC

(57) ABSTRACT

An insertion coupling for a boring rod assembly with at least two coupling elements is disclosed. The coupling elements include at least one corresponding tapered coupling face pair constructed to produce play-free clamping when pressing forces are applied to the insertion coupling.

11 Claims, 2 Drawing Sheets

INSERTION COUPLING FOR A BORING ROD ASSEMBLY AND A BORING ROD ASSEMBLY

CROSS-REFERENCES TO RELATED APPLICATIONS

This application claims the priority of German Patent Application Serial No. 10 2009 039 020.0, filed Aug. 28, 2009 and the priority of German Patent Application Serial No. 10 2009 052 335.9, filed Nov. 7, 2009, pursuant to 35 U.S.C. 119(a)-(d), the content of which is incorporated herein by reference in its entirety as if fully set forth herein.

BACKGROUND OF THE INVENTION

The present invention relates to an insertion coupling for a boring rod assembly as well as to a boring rod assembly having one or several such insertion couplings.

The following discussion of related art is provided to assist the reader in understanding the advantages of the invention, and is not to be construed as an admission that this related art is prior art to this invention.

Several methods and devices have been developed for introducing horizontal bore holes in the ground. New pipes or cables for supplying, for example, water or electricity can be inserted simultaneously or at a later time into these bore holes.

Some conventional horizontal boring apparatuses introduce a bore hole in the ground with a boring assembly having a bore head attached to the front end by way of a drive apparatus arranged in a starting shaft or above ground.

A thrust force as well as a torque is transmitted to the bore head by the drive apparatus to advance the bore head in the ground. It is also known to provide this drive apparatus additionally with an impact drive, which can be activated as needed, when the bore head hits in the ground an obstacle, for example a rock. The obstacle is then destroyed by producing impact pulses and transmitting the impact pulses to the bore head via the boring rod assembly, whereafter a normal, i.e., pushing and rotating boring operation can be resumed. In general, the boring rod assemblies used with these horizontal boring apparatuses have sections (rod sections) connected with each other via screw connections. Screwing the individual rod sections together can be performed automatically with a suitable design of the drive apparatus. Advantageously, the use of screw connections with boring rod assemblies for the aforedescribed horizontal boring apparatuses results in relatively low manufacturing costs and the elimination of play in the transmission of both pressing forces (in particular also impact pulses) and pulling forces as well as torque in at least one rotation direction. Disadvantageously, however, (large) torques can fundamentally not be transmitted in the release location direction of the screw connection. In addition, screwing together the individual rod sections is time-consuming even if performed automatically.

Rod assemblies are known in the technical field of trenchless pipe installation, wherein the pipe sections are connected with each other by insertion couplings. These assemblies are pushed from a target shaft (for a pipe to be installed) with a pulling device, which may also be configured to apply a push, through an already established bore or a channel pipe to be restored and are connected to with the pipe to be installed via an adapter after reaching a starting shaft. The pipe is then pulled into the bore or channel pipe with the pulling apparatus. Such assemblies must be able to transmit large pulling forces, but only small pressing forces (during the initial push from the target shaft into the starting shaft) and no impact pulses or torques at all. For this reason, no boring rod assemblies connected with each other by insertion couplings have been used to date for the aforedescribed horizontal boring apparatuses, where the boring assembly is driven through the ground by an aboveground drive unit by both pushing as well as rotating and partially by performing impact pulses.

It would therefore be desirable and advantageous to address this problem and to obviate other prior art shortcomings by providing a boring rod assembly with a plurality of rod sections, wherein the rod sections can be easily connected with each other and are able to reliably transmit even large pressing forces.

SUMMARY OF THE INVENTION

The boring rod assembly according to the invention is composed of a plurality of rod sections, wherein the individual rod sections are at least partially connected with each other by an insertion coupling constructed according to the invention.

An insertion coupling according to the invention for such boring rod assembly includes at least two coupling elements, wherein the coupling elements form at least one corresponding tapered coupling face pair, so that (substantially) play-free clamping is produced when pressing forces are applied to the insertion coupling. The clamping between the two coupling elements of the insertion coupling produced with the invention enables a direct and substantially lossless transmission of pressing forces and impact pulses via the boring rod assembly constructed of several rod sections.

Preferably, the insertion coupling according to the invention has a relatively small taper angle (i.e. the angle formed between the tapered face and the longitudinal axis of the respective coupling element). This angle is preferably not greater than 10° and particularly preferred not greater than 5° (with reference to the longitudinal axes of the coupling elements). In a particularly preferred embodiment, the two coupling elements of the insertion coupling can have corresponding conical sections.

In a preferred embodiment of the insertion coupling according to the invention, the coupling elements have at least one second corresponding coupling face pair for transmitting a torque in the coupled state of the insertion coupling. The boring rod assembly can then be used with boring methods where a torque is to be transmitted from a drive apparatus to a bore head located on the front end of the boring rod assembly, as may be required, for example, for implementing a steering function of the boring rod assembly.

To this end, the boring rod assembly can be provided on its front end with an inclined steering face producing transverse forces (in relation to the longitudinal axis of the boring rod assembly), which cause a sideways deflection of the front end of the boring rod assembly. This results in an arcuate course of the bore when the boring rod assembly is stationary, i.e., not rotationally driven. A change in the steering can be achieved by rotating the boring rod assembly manually or by a suitable (rotary) drive about its longitudinal axis by a defined angle, thereby reorienting the inclined steering face. A quasi-straight bore course can be attained in principle by continuously rotating the boring rod assembly, so as to compensate for the transverse (deflection) forces during a rotation of the front end of the boring rod assembly.

In particular, when the boring rod assembly is configured to be steerable by, for example, an inclined steering face on the front end of the boring rod assembly, one of the front rod sections and, more particularly, the rod section closest to the front of the boring rod assembly according to the invention may advantageously be equipped with a locating sensor for determining the position of the corresponding rod section. This makes it possible to determine and steer the exact course of the bore.

For transmitting a torque and/or for forming the second corresponding coupling face pair, one of the coupling elements can be provided with a mandrel which is flattened at least on one side to form a coupling face and which engages in the coupled state of the insertion coupling with a recess on the second coupling element, in which likewise a corresponding coupling face is formed.

In another preferred embodiment of the insertion coupling of the invention, the coupling elements have at least one third corresponding coupling face pair configured to transmit pulling forces in the coupled state of the insertion coupling. Pulling forces can be applied on the boring rod assembly, for example, to retract the assembly after producing a bore. If the pulling forces are so large, that the non-positive connection of the first corresponding coupling face pair or of the insertion coupling(s) is released, then a complete release of the individual insertion coupling(s) is prevented by the third coupling face pair. If one of the insertion couplings of the boring rod assembly is completely released, then the disconnected part of the growing rod assembly would have to be recovered by excavation.

In another preferred embodiment of the insertion coupling of the invention, a displacement path may be provided between two relative positions of the coupling elements, where either the first coupling face pair or the third coupling face pair abut one another. This displacement path may be used to implement the insertion coupling releasably.

With this embodiment of the insertion coupling according to the invention, the second coupling face pair abuts each other in both relative positions of the two coupling elements, so that a torque can be transmitted via the insertion coupling both during advance as well as during retraction of the boring rod assembly (i.e., when pulling forces are applied).

Preferably, the insertion coupling can be constructed to be releasable by first pivoting the two coupling elements with respect to each other and then rotating one of the coupling elements by a defined angle about its own longitudinal axis. With these sequential relative movements of the two coupling elements with respect to one another, the insertion coupling according to the invention can be prevented from being unintentionally released during the normal boring operation.

For an optional manual release the insertion coupling according to the invention, for example when a rod section of the boring rod assembly has arrived at its target location (e.g., a target shaft) after the boring operation, means may preferably be provided for releasing clamping of the first coupling face pair. To this end, a transverse opening may be provided in one of the coupling elements, in which for example a wedge may be driven, with the wedge applying a force on the corresponding other coupling element for releasing the clamping.

According to another preferred embodiment of the boring rod assembly according to the invention, the rod sections may at least in sections have a tubular structure. In this way, the weight of the individual rod sections of the boring rod assembly can be reduced. Moreover, a boring rod assembly can be produced with a suitable design of the rod sections, in particular with respect to the outside diameter and the wall thickness of the tubular sections, which is not only capable of transmitting large impact pulses, pulling forces and torques, but is also bendable so as to enable good steerability in the ground.

The rod sections of the boring rod assembly may also include a marking, for example a flat on one side of a bearing rod assembly having otherwise a round cross-section, for optically or automatically determining the roll angle in the ground.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
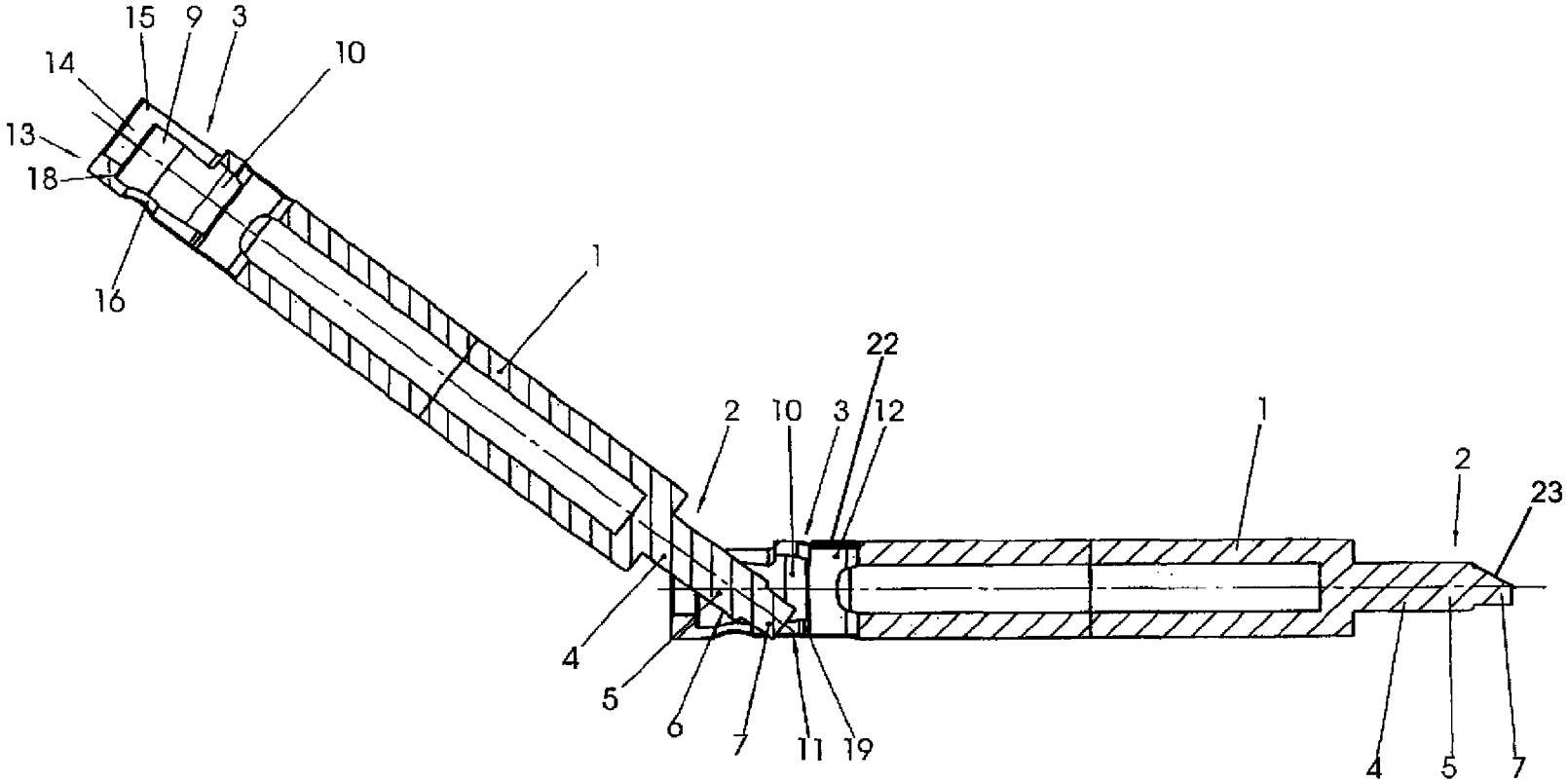
FIG. 1 a boring rod assembly according to the invention in a first coupling position in a cross-sectional side view.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there are shown two rod sections 1 of a boring rod assembly according to the invention which are implemented in tubular form having a circular cross section. Each of the rod sections 1 has two coupling elements disposed at the respective ends, which form an insertion coupling according to the invention. The rod sections 1 can be connected with each other by way of this insertion coupling, wherein pulling and pressing forces as well as a torque can be transmitted in both rotation directions.

One of the coupling elements on each rod section 1 is constructed as an insertion part 2 which is inserted into the other coupling element of the adjacent rod section 1 constructed as receiving part 3.

The coupling element constructed as an insertion part 2 has a shaft 4 of circular cross section. This shaft transitions into a locking shoulder 5, which has a circular cross section and a diameter that is greater than the diameter of the shaft 4, but which is flattened on two opposing sides by milling flat faces 6. In addition, the locking shoulder 5 is conically tapered with a small taper angle of about 5° (see FIG. 2). The insertion part transitions from this locking shoulder 5 into a mandrel 7 which is produced, like the locking shoulder 5, starting from a circular cross section with a diameter that is smaller than the diameter of the shaft 4, by milling flat faces 8 on two opposing sides. The flat faces 6 of the locking section 5 are rotated by 90° (with respect to the longitudinal axis of the respective rod section) relative to the flat faces 8 of the mandrel 7.

Figure 2:
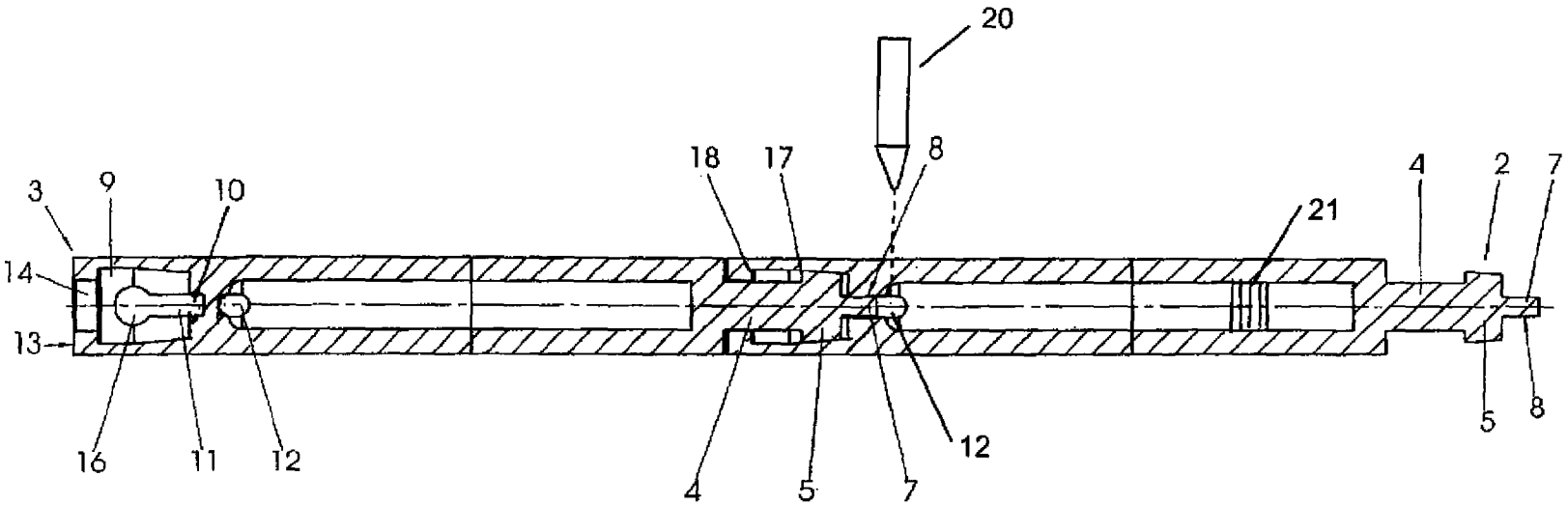
FIG. 2 the insertion coupling according to FIG. 1 in a second coupling position in a cross-sectional top view.

The coupling element configured as the receiving part 3 is produced by introducing several defined bores in the respective rod section 1. In this way, openings with walls are formed, wherein the walls cooperate with corresponding effective faces of the corresponding insertion part 2 for transmission of forces and torques. For forming the receiving part 3, each rod section 1 has the following openings on one end:

A central bore 9 having a circular cross section is used to receive in the coupled state of the insertion coupling the locking shoulder 5 as well as one respective section of the shaft 4 and the mandrel 7 of the insertion part 2 (see FIG. 2). A section of the central bore 9 has—like the locking section 5 of the insertion part 2—a conical taper. The conical faces of the locking shoulder 5 of the insertion part 2 and of the central bore 9 of the receiving part 3 together form a (first) coupling face pair, which produces play-free clamping when pressing forces are applied on the insertion coupling.

The central bore 9 transitions at its front side into a mandrel opening 10, which has a width that is slightly greater than the distance between the two flat faces 8 of the mandrel 7. The front section of the mandrel 7 extends in the coupled state of the insertion coupling into this mandrel opening 10 (see FIG. 2). The mandrel opening 10 tapers off on one side (in FIG. 2 pointing downward), forming a corresponding opening in the surface of the rod section (first side opening 11). The flat faces 8 of the mandrel 7 and the large side faces of the mandrel opening 10 together form a (second) coupling face pair which enables transmission of a torque in both directions.

The mandrel opening 10 transitions into a section of a transverse bore 12.

Another, short bore 14 (extending into the longitudinal direction of the rod section), which has a diameter that is smaller than the diameter of the central bore 9 and also tapers off towards one side (in FIG. 1 pointing upward) is introduced in the rearward end face 13 of the receiving part 3; the bore 14 transitions at this location into a (second) side opening 15 which extends to the conical section of the central bore. The laterally tapering rearward bore 14 and the (second) side opening 15 together from an L-shaped opening. The width of the L-shaped opening is only slightly greater than the distance between the two flat faces 6 of the locking shoulder 5 and is smaller than the (greater) diameter of the conical locking shoulder 5.

A (third) side opening 16 with a circular cross section is arranged in opposition to the (second) side opening 15. The third side opening 16 transitions into the (second) side opening 11 formed by the mandrel opening 10.

The rod sections 1 are connected with the insertion coupling according to the invention as follows:

The rod section 1 with the insertion part 2 for the respective insertion connection (the left rod section in FIGS. 1 and 2) is attached at an angle of about 90° with respect to the other rod section 1, and the insertion part 2 is inserted in the receiving part 3 through the second side opening 15. The flat faces 6 of the locking shoulder 5 are thereby oriented parallel to the side faces of the L-shaped opening (and therefore also parallel to the longitudinal axes of the rod sections 1). The mandrel 7 extends hereby into the third side opening 16.

After insertion, the rod section 1 with the insertion part 2 is rotated by 90° about its longitudinal axis, thereby bringing the edge forming the large diameter of the locking shoulder 5 into contact with the interior surface of the central bore 9. At the same time, the (large) diameter of the locking section 5, which extends beyond the width of the L-shaped opening, already prevents a sideways or rearward release of the insertion coupling. The circular shape of the third side opening 16 enables rotation of the mandrel 7 which has flats on both sides.

The two rod sections 1 are then rotated by about 90° into the coaxial position, as illustrated in FIG. 2. In this position, the rearward locking face 17 of the locking shoulder 5 abuts the step formed by the change in diameter between the rearward bore 14 and central bore 9. The stepped face 18 and the rearward locking face 17 form a (third) coupling face pair configured to transmit pulling forces between the rod sections 1 (pulling position of the insertion coupling). In this position of the insertion coupling, the front section of the mandrel 7 already extends into the mandrel opening 10. In this way, a torque can also be transmitted in the pulling position of the insertion coupling in both rotation directions. The second side opening 11 enables pivoting of the mandrel 7 from the third side opening 16 into the mandrel opening 10.

As shown schematically in FIG. 1, the boring rod assembly can be provided on its front end with an inclined steering face 23 producing transverse forces (in relation to the longitudinal axis of the boring rod assembly), which cause a sideways deflection of the front end of the boring rod assembly. As also shown in FIG. 1, the rod sections of the boring rod assembly may also include a marking 22, for example a flat on one side of a bearing rod assembly having otherwise a round cross-section, for optically or automatically determining the roll angle in the ground. As shown schematically in FIG. 2, the rod section closest to the front of the boring rod assembly may be equipped with a locating sensor 21 for determining the position of the corresponding rod section.

When applying pressing forces, the two coupling elements are displaced relative to each other until clamping of the first coupling face pair is attained (pressing position of the insertion coupling—see FIG. 2). In this position, the mandrel 7 protrudes slightly into the transverse opening 12 and overlaps at the same time a step 19 formed between the transverse opening 12 and the second side opening 11. This step prevents unintentional pivoting of the two rod sections 1 in the pressing position of the insertion coupling. Pressing forces can thereby be transmitted without causing unintentional angular misalignment between the rod sections, which may result in an unintentional release of the insertion coupling. The rod sections 1 can therefore only be pivoted starting from the pulling position.

Because strong clamping of the first coupling face pair may be produced depending on the magnitude of the transmitted pressing forces, correspondingly high pulling forces may be required to switch the insertion coupling from the pressing position into the pulling position, which is required for releasing the insertion coupling. If these pulling forces have not previously been generated automatically, for example by retracting the rod assembly under load, or manually, a (widening) mandrel 20 may be beat into the transverse opening 12 to apply to the front end of the mandrel 7, which extends in the pressing position of the insertion coupling into the transverse opening 12, separation forces in the direction of the longitudinal axis of the rod section 1.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. An insertion coupling for a boring rod assembly comprising at least two coupling elements having at least one first tapered coupling face pair, said at least one first tapered coupling face pair constructed to produce play-free clamping when pressing forces are applied to the insertion coupling, the at least two coupling elements further comprising at least one second corresponding coupling face pair constructed to transmit a torque in a coupled state, wherein a first of the at least two coupling elements comprises a mandrel, which has a flat on at least one side for forming a coupling face and which in a coupled state engages in a recess forming a corresponding coupling face of a second coupling element.

2. The insertion coupling of claim 1, wherein a taper angle of the at least one first coupling face pair is ≦10° in relation to a longitudinal axis of a coupling element.

3. The insertion coupling of claim 1, wherein the at least two coupling elements comprise at least one third corresponding coupling face pair configured for transmission of pulling forces in the coupled state.

4. The insertion coupling of claim 3, wherein in a first relative position of the at least two coupling elements with respect to each other, the first coupling face pair abuts each other, and in a second relative position the third coupling face pair abuts each other.

5. The insertion coupling of claim 4, wherein the second coupling face pair abuts each other in both the first and the second relative position.

6. An insertion coupling for a boring rod assembly comprising at least two coupling elements having at least one first tapered coupling face pair, said at least one first coupling face pair constructed to produce play-free clamping when pressing orces are applied to the insertion coupling, wherein the insertion coupling is releasable by first pivoting the coupling elements with respect to each other and then rotating at least one of the coupling elements about its longitudinal axis.

7. An insertion coupling for a boring rod assembly comprising at least two coupling elements having at least one first tapered coupling face pair, said at least one first coupling face pair constructed to produce play-free clamping when pressing forces are applied to the insertion coupling, wherein one of the at least two coupling elements comprises a transverse opening constructed for receiving a widening mandrel, wherein by driving the widening mandrel a separation force is applied on another coupling element for releasing an clamping connection between the coupling elements.

8. A boring rod assembly having a plurality of rod sections connected at least in part with one another by an insertion coupling, wherein the insertion coupling comprises at least two coupling elements having at least one first tapered coupling face pair, said at least one first coupling face pair constructed to produce play-free clamping when pressing forces are applied to the insertion coupling, and wherein a most forward rod section of the plurality of rod sections comprises a locating sensor.

9. The boring rod assembly of claim 8, wherein a front end of the boring rod assembly comprises an inclined steering face.

10. The boring rod assembly of claim 8, wherein at least sections of the rod sections are constructed in the form of pipes.

11. A boring rod assembly having a plurality of rod sections connected at least in part with one another by an insertion coupling, wherein the insertion coupling comprises at least two coupling elements having at least one first tapered coupling face pair, said at least one first coupling face pair constructed to produce play-free clamping when pressing forces are applied to the insertion coupling, wherein the rod sections comprise a marking for determining roll.

* * * * *